US009818367B2

(12) United States Patent
Lin et al.

(10) Patent No.: US 9,818,367 B2
(45) Date of Patent: Nov. 14, 2017

(54) CONTENT-DRIVEN SLEW RATE CONTROL FOR DISPLAY DRIVER

(71) Applicant: APPLE INC., Cupertino, CA (US)

(72) Inventors: Hung Sheng Lin, San Jose, CA (US); Chaohao Wang, Sunnyvale, CA (US); Paolo Sacchetto, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 161 days.

(21) Appl. No.: 14/660,619

(22) Filed: Mar. 17, 2015

(65) Prior Publication Data

US 2016/0275897 A1 Sep. 22, 2016

(51) Int. Cl.
*G09G 3/36* (2006.01)

(52) U.S. Cl.
CPC ..... *G09G 3/3696* (2013.01); *G09G 3/3648* (2013.01); *G09G 3/3688* (2013.01); *G09G 2310/027* (2013.01); *G09G 2310/0289* (2013.01); *G09G 2310/0291* (2013.01); *G09G 2320/0209* (2013.01); *G09G 2320/029* (2013.01); *G09G 2330/06* (2013.01); *G09G 2330/08* (2013.01)

(58) Field of Classification Search
CPC ..... G09G 3/3688; G09G 2310/027; G09G 2310/0291
See application file for complete search history.

(56) References Cited

U.S. PATENT DOCUMENTS

| | | | | |
|---|---|---|---|---|
| 7,859,504 | B2 | 12/2010 | Furihata et al. | |
| 8,373,729 | B2 | 2/2013 | Lee et al. | |
| 8,537,083 | B2 | 9/2013 | Nakatsuka | |
| 2002/0008686 | A1 | 1/2002 | Kumada et al. | |
| 2004/0164943 | A1 | 8/2004 | Ogawa et al. | |
| 2010/0097078 | A1* | 4/2010 | Philipp | G06F 3/0418 324/684 |
| 2012/0032932 | A1 | 2/2012 | Kojima | |
| 2012/0280965 | A1* | 11/2012 | Lee | G09G 3/3677 345/212 |
| 2013/0083245 | A1* | 4/2013 | Gopalakrishna | H04N 5/213 348/606 |
| 2013/0113848 | A1* | 5/2013 | Bae | G09G 3/3688 345/691 |
| 2015/0130851 | A1* | 5/2015 | Jeong | G09G 3/20 345/690 |
| 2016/0078826 | A1* | 3/2016 | Yoo | G09G 3/3607 345/691 |

* cited by examiner

*Primary Examiner* — Ryan A Lubit
(74) *Attorney, Agent, or Firm* — Fletcher Yoder PC

(57) ABSTRACT

Devices and methods related to liquid crystal displays (LCDs) are provided. For example, such an electronic device may include an LCD with a slew rate control unit that adjusts a slew rate for source drivers of the LCD. The slew rate may be adjusted differently for each source driver and for each frame of data signal delivered by the source driver. Individually adjusting the slew rate of the source driver enables the LCD to respond to or reduce noise within the LCD that may otherwise contribute to flickering or other unwanted display events.

20 Claims, 5 Drawing Sheets

CONTENT-DRIVEN SLEW RATE CONTROL FOR DISPLAY DRIVER

BACKGROUND

The present disclosure relates generally to liquid crystal display (LCD) panels and, more particularly, to display drivers for LCD panels that adjust source driver slew rates based on content to be displayed.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Display panels are commonly used as part of an electronic device to provide visual information from the device. One type of display is a liquid crystal display (LCD), which may include a grid of rows and columns of thin-film-transistors (TFTs) arranged in a layer adjacent to liquid crystal material. The TFTs may control one or more image pixels for each image displayed on the device. The LCD may selectively modulate the amount and color of light passing through each of the pixels by a varying an electric field associated with each respective pixel to control the orientation of the liquid crystals. By controlling the amount of light that may be emitted from each pixel, the LCD may cause a viewable image to be displayed.

During operation of an LCD, the gate of a TFT associated with a pixel may be switched on upon receiving a gate activation signal provided by a gate driver circuit. When the TFT is switched on, a data voltage applied to the source of the TFT may be stored as a charge in a pixel electrode coupled to the TFT. By way of example, the TFTs within the pixel array may be switched on sequentially one row at a time, and image data corresponding to a selected row may be sent to the pixels of the selected row when it is activated. When the source of the TFT transitions from a minimum voltage to the data voltage, rise and fall transition time properties (e.g., slew rate) of source signal may influence and affect channel charge distribution behavior of the TFT. For instance, when a TFT is switched from an on state to an off state, charge remaining in the channel of the transistor is redistributed between a corresponding pixel electrode and source line. This redistribution may be called coupling, and in some instances may affect the voltages throughout the circuitry of the LCD panel. Coupling may also change or affect the amount of light emitted by the pixels, which can cause inconsistencies in color and luminance over the entire LCD panel.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Embodiments of the present disclosure relate to devices and methods related to liquid crystal displays (LCDs). For example, such an electronic device may include an LCD with a slew rate control unit that controls a slew rate for individual source drivers of each data line in the LCD. The slew rate may be adjusted based on frame to frame data voltage movement to minimize the alternating current coupling effect. The slew rate may also be adjusted in response to feedback from sensors that detect system noise and/or from the data signals being delivered to the LCD. Rather than adjusting the slew rate of the entire LCD during manufacture, the LCD may achieve better picture quality, lower noise levels, and brighter light luminance by adjusting the slew rate dynamically during operation of the LCD. The slew rate may be adjusted globally for the entire LCD, or may be adjusted for each individual source driver based on the current line charge and forthcoming data signals.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. The embodiments discussed below are intended to be examples that are illustrative in nature and should not be construed to mean that the specific embodiments described herein are necessarily preferential in nature. Additionally, it should be understood that references to "one embodiment," "an embodiment," "some embodiments," and the like are not intended to be interpreted as excluding the existence of additional embodiments that also incorporate the disclosed features.

Present embodiments relate to a liquid crystal display (LCD) panel. In particular, the development, production, and/or use of such a LCD panel may include adjusting the slew rate of a data signal within the LCD panel to reduce display noise. More specifically, the embodiments discussed herein relate to adjusting the slew rate on a line-by-line or frame-by-frame basis. The slew rate may be adjusted between a number of possible settings to balance the noise and recovery time of the data lines within the LCD panel. Several factors may influence the noise and recovery time of the data lines. Primarily, the data signal may produce noise on a data line, particularly when the data signal includes significant change in voltage (i.e., bright pixel intensity to dark pixel intensity, or vice versa). Additionally, display noise may be generated from a number of sources, including signals from the LCD panel itself, or external sources such as touch sensors or wireless/radio signals.

As explained in detail below, the present embodiments include slew adjustment circuitry to adjust the slew rate for each of the source drivers for each data line, which may thus individually adjust the slew rate for each of the data lines. It is believed that these embodiments enable a LCD panel that is responsive to system noise and emits a more consistent high-quality picture.

Figure 1:
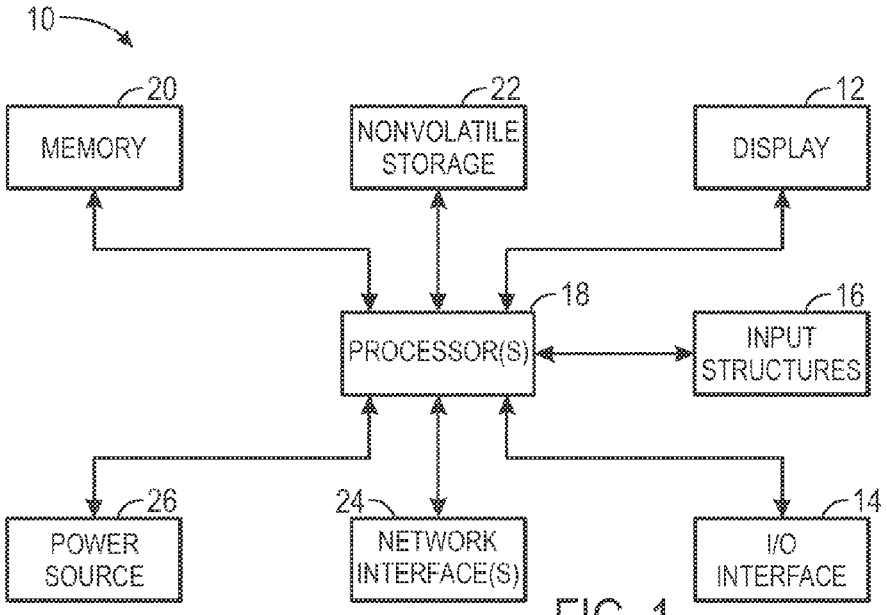
FIG. 1 is a block diagram of exemplary components of an electronic device, in accordance with aspects of the present disclosure.

With the foregoing points in mind, FIG. 1 provides a block diagram illustrating an example of an electronic device 10 that may include logic configured to control the slew rate of source driver signals sent to a display 12, such as a liquid crystal display (LCD), in accordance with aspects of the present disclosure. The electronic device 10 may be any type of electronic device, such as a laptop or desktop computer, a mobile phone, a digital media player, or the like, that includes the display 12. The various functional blocks depicted in FIG. 1 may include hardware elements (including circuitry), software elements (including computer code stored on computer-readable media, such as a hard drive or system memory), or a combination of both hardware and software elements. It should be noted that FIG. 1 is merely one example of a particular implementation and is merely intended to illustrate the types of components that may be present in the electronic device 10. For example, in the illustrated embodiment, these components may include the display 12 referenced above, as well as input/output (I/O) ports 14, input structures 16, one or more processors 18, memory device(s) 20, non-volatile storage 22, network interface(s) 24 (e.g., wireless and/or physically connected networks), and power source 26.

Before continuing, it should be understood that the system block diagram of the electronic device 10 shown in FIG. 1 is intended to represent a high-level control diagram. That is, the illustrated connective lines between each individual component shown in FIG. 1 may not necessarily represent paths or directions through which data flows or is transmitted between various components of the device 10, but is merely intended to show that the processor(s) 18 may interface and/or communicate either directly or indirectly with each component of the device 10. Additionally, the blocks represented in the block diagram may not represent relative locations of the components. Each of the components represented by the blocks may be integrally formed together which can cause the signals to each of the various components to influence each other in ways that cannot be predicted during manufacture of the device 10.

The display 12 may be used to display various images generated by the electronic device 10. In the illustrated embodiment, the display 12 may be a liquid crystal display (LCD), such as an LCD that employs fringe-field switching (FFS), in-plane switching (IPS) or other techniques use in operating such LCD devices. The display 12 may be a color display utilizing a plurality of color channels for generating color images. By way of example, the display 12 may utilize a red, green, and blue color channel. As discussed further below, the display 12 in the form of an LCD may include a panel having an array of thin-film transistors (TFTs) representative of image pixels, and may also include slew rate control circuitry that is configured to select a desired slew rate for gate activation signals supplied to the TFTs to reduce the effects of voltage kickback and coupling (which may cause visual artifacts, such as flicker, to occur), and thus improve overall image quality. Further, in other embodiments, the display 12 may also be a display that uses plasma or organic light emitting diode (OLED) technologies. In one embodiment, the display may be a high-resolution LCD display having 300 or more pixels per inch, such as a Retina Display®, available from Apple Inc. Moreover, in some embodiments, the display 12 may be provided in conjunction with a touch-sensitive element, such as a touch screen, that may function as one of the input structures 16 for the electronic device 10. For instance, the touch screen may sense inputs based on contact with a user's finger or with a stylus. As hinted at above, the input structures 16, particularly those touch-based input structures 16 that are integrally formed with the display 12, can cause coupling of signals that affect signals to the display 12.

The processor(s) 18 may control the general operation of the device 10. For instance, the processor(s) 18 may provide the processing capability to execute an operating system, programs, user and application interfaces, and any other functions of the electronic device 10. The processor(s) 18 may include one or more microprocessors, such as one or more "general-purpose" microprocessors, one or more special-purpose microprocessors and/or application-specific microprocessors (ASICs), or a combination of such processing components. For example, the processor(s) 18 may include one or more processors based upon x86 or RISC instruction set architectures, as well as dedicated graphics processors (GPU), image signal processors, video processors, audio processors and/or related chip sets. By way of example only, the processor(s) 18 may, in one embodiment, include a model of a system-on-a-chip (SoC) processor, such an A4 processor, available from Apple Inc. As should be appreciated, the processor(s) 18 may be coupled to one or more data buses for transferring data and instructions between various components of the device 10.

The instructions or data to be processed by the processor(s) 18 may be stored in a computer-readable medium, such as a memory device 20. The memory device 20 may be provided as volatile memory, such as random access memory (RAM), or as non-volatile memory, such as read-only memory (ROM), or as a combination of RAM and ROM devices. The memory 20 may store a variety of information and may be used for various purposes. For example, the memory 18 may store firmware for the device 10, such as a basic input/output system (BIOS), an operating system, various programs, applications, or any other routines that may be executed on the device 10, including user interface functions, processor functions, and so forth. The memory 20 may additionally be used for buffering or caching during operation of the device 10.

In addition to memory 20, the device 10 may further include a non-volatile storage 22 for persistent storage of data and/or instructions. The non-volatile storage 20 may include flash memory, a hard drive, or any other optical, magnetic, and/or solid-state storage media, or some combination thereof. Thus, although depicted as a single device in FIG. 1 for purposes of clarity, the non-volatile storage 22 may include a combination of one or more of such storage devices operating in conjunction with the processor(s) 18. The non-volatile storage 22 may be used to store firmware, data files, image data, software programs and applications, and any other suitable data. For instance, the non-volatile storage 22 may store image and/or video data that may be displayed and/or played back on the display device 12 for viewing by a user. Further, the RF circuitry 26 may enable the device 10 to connect to a network, such as a local area network, a wireless network (e.g., an 802.11x network or Bluetooth network), or a mobile network (EDGE, 3G, 4G, LTE, etc.), and to communicate with other devices over the network.

Figure 2:
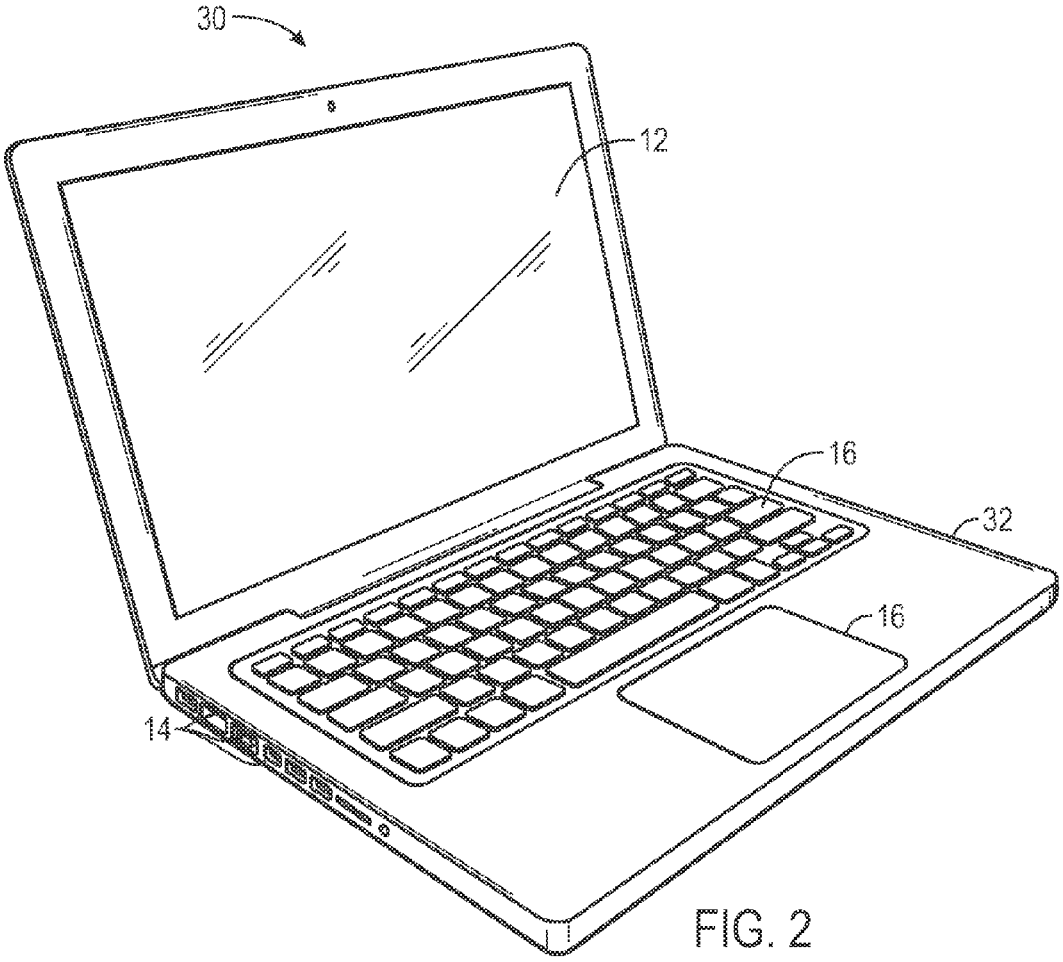
FIG. 2 is a front view of a handheld electronic device in accordance with aspects of the present disclosure.

FIG. 2 illustrates an embodiment of the electronic device 10 in the form of a computer 30. The computer 30 may include computers that are generally portable (such as laptop, notebook, tablet, and handheld computers), as well as computers that are generally used in one place (such as conventional desktop computers, workstations and/or servers). The depicted computer 30 includes a housing or enclosure 32, the display 12 (e.g., LCD or other suitable display), I/O ports 14, and input structures 16. By way of example, certain embodiments of the computer 30 may include a model of a MacBook®, MacBook Pro®, MacBook Air®, iMac®, Mac Mini®, or Mac Pro®, all available from Apple Inc.

The display 12 may be integrated with the computer 30 (e.g., the display of a laptop computer) or may be a standalone display that interfaces with the computer 30 through one of the I/O ports 14, such as via a DisplayPort, DVI, High-Definition Multimedia Interface (HDMI), or analog (D-sub) interface. For instance, in certain embodiments, such a standalone display 12 may be a model of an Apple Cinema Display®, available from Apple Inc. As will be discussed in further detail below, the display 12 in the form of the LCD may include logic for controlling the slew rate of data signals supplied by source drivers for to a TFT array of the LCD 34 in a manner that helps to reduce the occurrence of visual display artifacts, such as flicker, resulting from the effects of coupling and interference from system noise that may be present in the computer 30.

Figure 3:
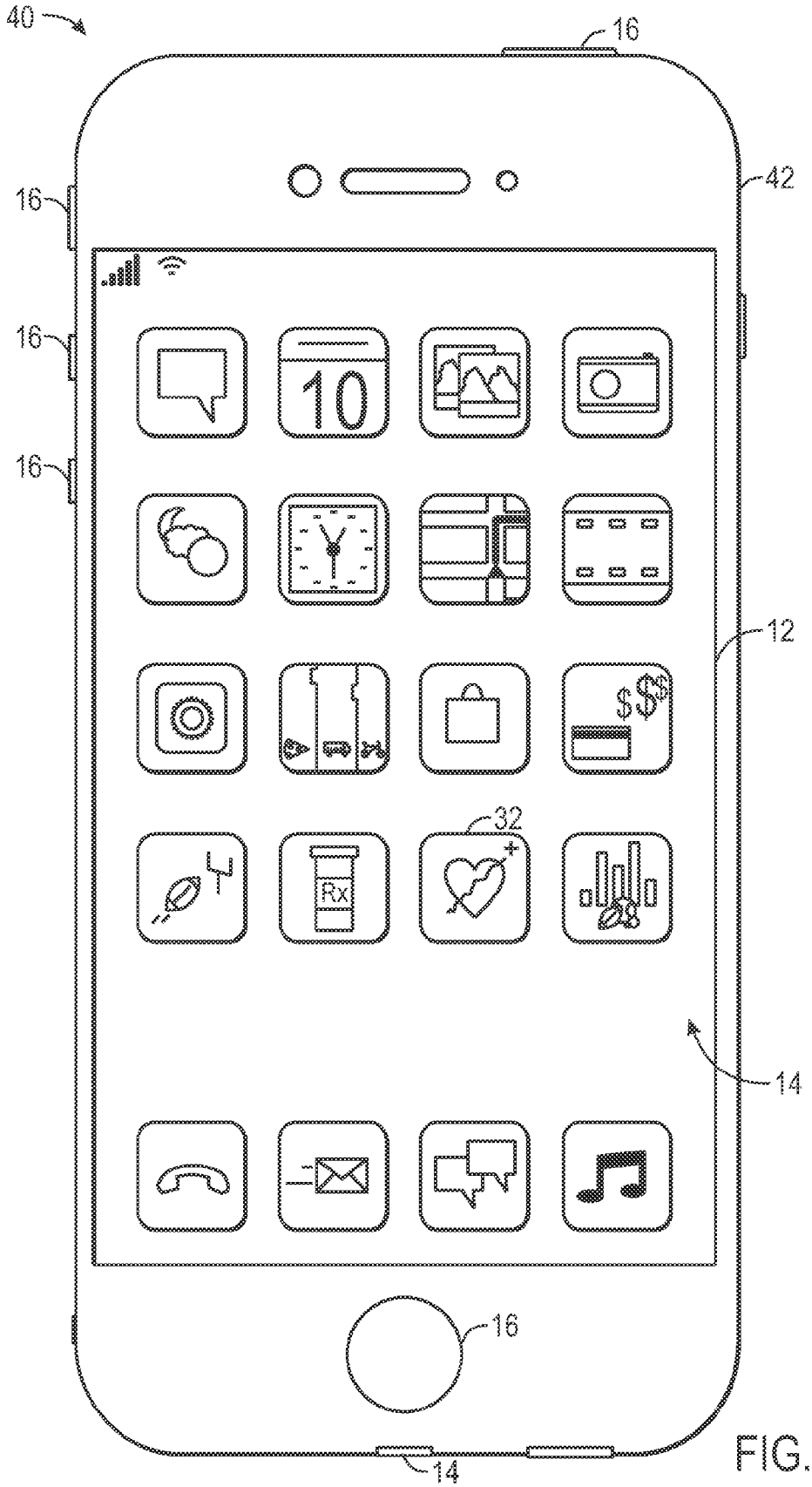
FIG. 3 is a view of a computer in accordance with aspects of the present disclosure.

FIG. 3 depicts the electronic device 10 in the form of a portable handheld electronic device 40, which may be a model of an iPod® or iPhone® available from Apple Inc. The handheld device 40 includes an enclosure 42, which may protect the interior components from physical damage and may also allow certain frequencies of electromagnetic radiation, such as wireless networking and/or telecommunication signals, to pass through to wireless communication circuitry (e.g., network interfaces 24), which may be disposed within the enclosure 42. As shown, the enclosure 42 also includes various user input structures 16 through which a user may interface with the device 10. For instance, each input structure 14 may be configured to control one or more device functions when pressed or actuated.

The device 40 also includes various I/O ports 14. For example, a connection port 14 (e.g., a 30-pin dock-connector available from Apple Inc. or a lightning dock-connector available from Apple Inc.) for transmitting and receiving data and for charging the power source 26, which may include one or more removable, rechargeable, and/or replaceable batteries. The I/O ports 14 may also include an audio connection port 14 for connecting the device 40 to an audio output device (e.g., headphones or speakers).

The display 12 may display various images generated by the handheld device 40. For example, the display 12 may display a graphical user interface (GUI) 44 that allows a user to interact with the device 40. In the presently illustrated embodiment, the displayed screen image of the GUI 44 may represent a home-screen of an operating system running on the device 40, which may be a version of the Mac OS® or iOS® (previously iPhone OS®) operating systems, both available from Apple Inc. The GUI 44 may include various graphical elements, such as icons 46, corresponding to various applications that may be executed upon user selection (e.g., receiving a user input corresponding to the selection of a particular icon 46).

Figure 4:
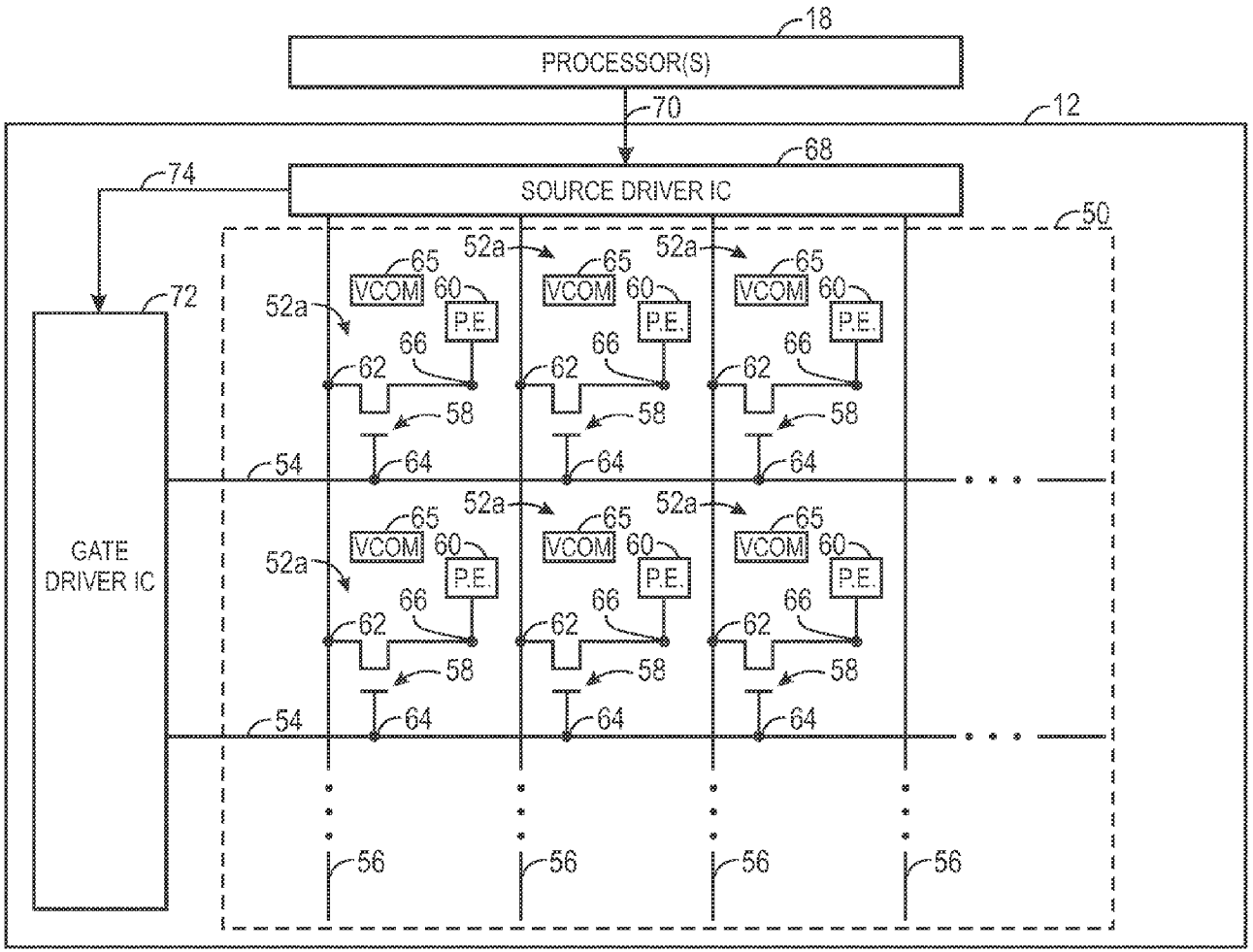
FIG. 4 is a circuit diagram of switching and display circuitry of LCD pixels, in accordance with aspects of the present disclosure.

As noted briefly above, the display 12 represented in the embodiments of FIGS. 1-3 may be a liquid crystal display (LCD). FIG. 4 represents a circuit diagram of such a display 12, in accordance with an embodiment. As shown, the display 12 may include an LCD display panel 50 including unit pixels 52 disposed in a pixel array or matrix. In such an array, each unit pixel 52 may be defined by the intersection of rows and columns, represented here by the illustrated gate lines 54 (also referred to as "scanning lines") and source lines 56 (also referred to as "data lines"), respectively. Only six unit pixels 52*a*-42*f* are shown for purposes of simplicity. However, it should be understood that in an actual implementation, each source line 56 and gate line 54 may include thousands or more of such unit pixels 52.

As shown in the present embodiment, each unit pixel 52 includes a thin film transistor (TFT) 58 for switching a data signal stored on a respective pixel electrode 60. In the depicted embodiment, a source 62 of each TFT 58 may be electrically connected to a source line 56 and a gate 64 of each TFT 58 may be electrically connected to a gate line 54. A drain 66 of each TFT 58 may be electrically connected to a respective pixel electrode 60. Each TFT 58 serves as a switching element that may be activated and deactivated (e.g., turned on and off) for a predetermined period based upon the respective presence or absence of a scanning signal at the gate 64 of the TFT 58.

When activated, the TFT 58 may store the image signals received via a respective source line 56 as a charge upon its corresponding pixel electrode 60. The image signals stored by the pixel electrode 60 may be used to generate an electrical field between the respective pixel electrode 60 and a common electrode 65. The electrical field between the respective pixel electrode 60 and the common electrode may alter the polarity of a liquid crystal layer above the unit pixel 52. The electrical field may align liquid crystals molecules within the liquid crystal layer to modulate light transmission. As the electrical field changes, the amount of light may increase or decrease. In general, light may pass through the unit pixel 52 at an intensity corresponding to the applied voltage (e.g., from a corresponding source line 56). As will be discussed below, however, lingering charges within the panel 50, stray charges from elsewhere within the device 10, and/or external electrical signals may influence the unit pixel 52 which can disrupt the applied voltage.

The display 12 also may include a source driver integrated circuit (IC) 68, which may include a chip, such as a processor or ASIC, that controls the display panel 50 by receiving image data 70 from the processor(s) 12 and sending corresponding image signals to the unit pixels 52 of the panel 50. The source driver IC 68 also may couple to a gate driver IC 72 that may activate or deactivate rows of unit pixels 52 via the gate lines 54. As such, the source driver IC 68 may send timing information, shown here by reference number 74, to gate driver IC 72 to facilitate activation/deactivation of individual rows of pixels 52. In other embodiments, timing information may be provided to the gate driver IC 72 in some other manner.

In operation, the source driver IC 68 receives the image data 70 from the processor(s) 12 or a separate display controller and, based on the received data, outputs signals to control the pixels 52. For instance, to display image data 70, the source driver IC 68 may adjust the voltage of the pixel electrodes 50 one row at a time. To access an individual row of pixels 52, the gate driver IC 72 may send an activation signal (e.g., an activation voltage) to the TFTs 48 associated with the row of pixels 52, rendering the TFTs 48 of the addressed row conductive. The source driver IC 68 may transmit certain data signals to the unit pixels 52 of the addressed row via respective source lines 56. Thereafter, the gate driver IC 72 may deactivate the TFTs 48 in the addressed row by applying a deactivation signal (e.g., a lower voltage than the activation voltage, such as ground), thereby impeding the pixels 52 within that row from changing state until the next time they are addressed. The above-described process may be repeated for each row of pixels 52 in the panel 50 to reproduce image data 70 as a viewable image on the display 12.

Figure 5:
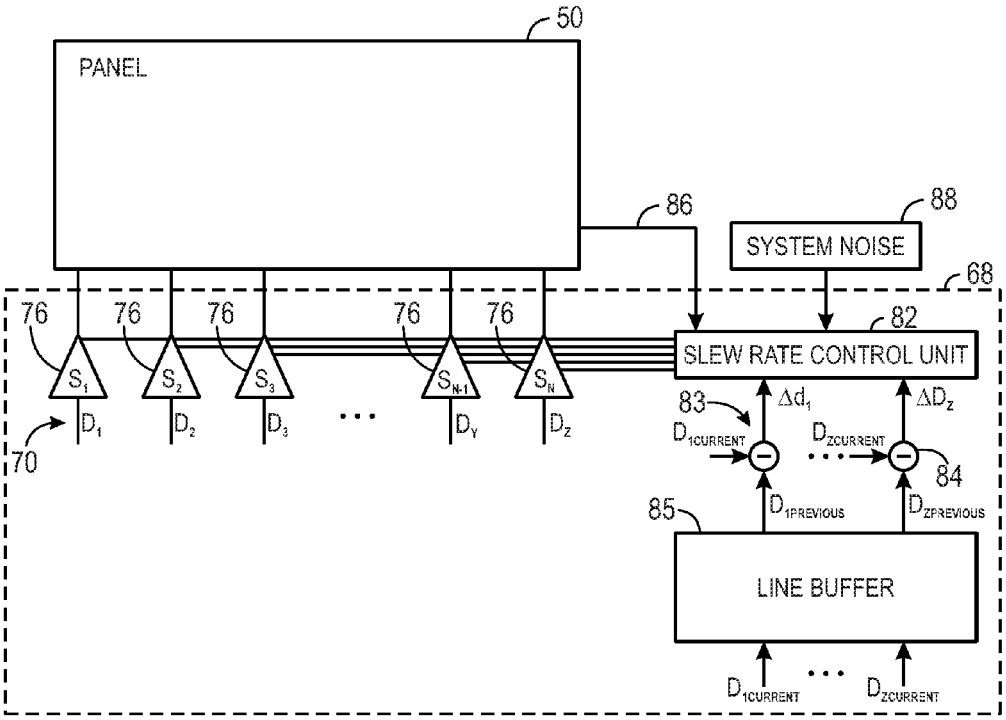
FIG. 5 is a schematic diagram of the LCD panel and the slew rate control unit.

The source driver IC 68 shown in FIG. 4 may be include a slew rate control unit 82 in a manner depicted in FIG. 5. As described above, the source driver IC 68 receives the image data 70 to deliver to the panel 50. The image data 70 may come from the processor(s) 18, or may come from other sources. The source driver IC 68 includes source drivers 76 that deliver the image data 70 to one or more of the source lines 56. Specifically, the source drivers 76 may deliver the image data 70 to 1, 2, 3, 4, or more source lines 56. Each source driver 76 (S1, S2, S3, Sy, Sz, wherein there are "Z" total source drivers 76) receives a data signal 70 (D1, D2, D3, Dy, Dz, again, a total of "Z" data signals 70 for the source drivers 76) that is specific to that source driver 76. Each source driver 76 individually adjusts the slew rate (i.e., the rate at which the signal on the source line 56 reaches the image data voltage) for the particular data signal (e.g., D1, D2, D3, Dy, Dz) that the source driver 76 receives. The source drivers 76 adjust the slew rate based on a slew rate signal 80 from a slew rate control unit 82. For example, if the first source driver 76 S1 receives a high slew rate signal 80 from the slew rate control unit 82, then the source driver 76 S1 will adjust the data signal so that it quickly reaches the data voltage. Alternatively, if the first source driver 76 S1 receives a low slew rate signal 80 from the slew rate control unit 82, then the source driver 76 S1 will adjust the data signal to reach the data voltage more gradually. This is shown in detail in FIG. 7.

To adjust the slew rate signal 80, the slew rate control unit 82 performs digital signal processing based on the image data 70, adjusted image data 83, and/or other signals or noise within the device 10. The update frequency of the slew rate adjustment may be limited to the frequency at which the source driver 76 updates the data signal 70 on the data line 56. Additionally, when the voltage difference between sequential frames is large, the slew rate may change significantly in response. In certain embodiments, the step size of these slew rate signals 80 is filtered to prevent flickering and/or other odd effects. In certain embodiments, the slew rate control unit 82 may receive the image data 70 (e.g., D1, D2, D3 . . . Dy, Dz) for each source driver 76 (e.g., S1, S2, S3 . . . Sy, Sz) to compare one data signal (e.g., D1) to a second data signal (e.g., D2). In other embodiments, the slew rate control unit 82 may receive adjusted image data 83 (e.g., ΔD1 . . . ΔDz) that has been adjusted by a comparator 84 with a delayed image data signal from a line buffer 85. The line buffer 85 receives the image data 70 for each source driver 76 and holds the image data 70 for one frame or one line (i.e., until the gate driver IC 72 deactivates one gate line 54 and activates the next). The comparator 84 then compares the previous image data 70 (e.g., $D1_{previous}$) to the current image data 70 (e.g., $D1_{current}$) for each source driver 76 (i.e., $D1_{previous}$ . . . $Dz_{previous}$ compared respectively to $D1_{current}$ . . . $Dz_{current}$) to determine the adjusted image data 83 (e.g., ΔD1 . . . ΔDz). The slew rate control unit 82 uses the adjusted image data 83 in part to select the slew rate signal 80 to deliver to the source drivers 76.

Also illustrated in the diagram of FIG. 5 are signals that the source driver IC 68 may receive from the device 10 and the panel 50. As explained below, the source driver IC 68 may adjust the slew rate of the source drivers 76 based on a settling signal 86 from the panel 50 and system noise 88 from the device 10. Each of the settling signal 86 and the system noise 88 may include analog signals converted to digital signals so that the source driver IC 68 may determine a degree to which the settling signal 86 and the system noise 88 may be affecting the image within the pixel 52. The settling signal 86 may include timing information indicative of how the pixels are disturbed and how soon the pixels recover from noise that may be generated when the data signal or other signals are applied within the display 50.

Figure 6:
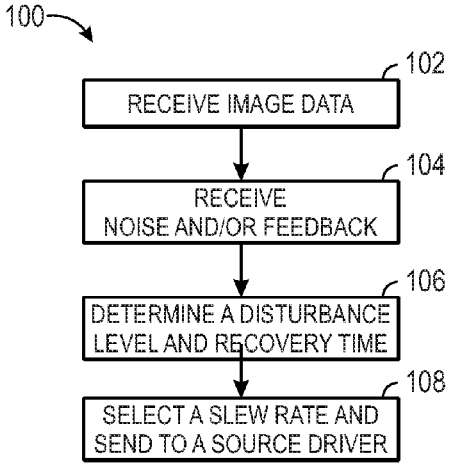
FIG. 6 is a diagram of voltages delivered by the source drivers and experienced by the pixels of the LCD panel.

To determine the slew rate for each source driver 76, the slew rate control unit 82 may employ a method 100 illustrated in FIG. 6. The method 100 starts when the source driver IC 68 receives 102 the image data 70. The image data 70 may be received directly by the source drivers 76, and may also be received by the slew rate control unit 82, the line buffer 85, or any combination thereof. The image data 70 is received as frames of images for the panel 50. The frames of the image data 70 may, for a given time period, remain consistent from one frame to the next. In other instances, such as when the device is playing a video, the frames of the image data 70 may include images that change significantly in the amount of luminance from one frame to the next. In such circumstances, the fast changing of the signal from the source drivers 76 may increase the potential for noise within the panel 50. In other circumstances, the image data 70 from the same source driver (e.g., D1 data for S1 source driver) may vary from one gate line 54 to the next. These circumstances have the potential to cause noise in the display 50 and/or prolong the recovery time of the pixel which can cause inefficiency in the display 50. The line buffer 85 may be programmed to recognize the potential for noise and indicate to the slew rate control unit 82 to adjust the slew rate accordingly.

As part of the method 100 performed by the source driver IC 68, the source driver IC 68 also receives 104 noise from the device 10 and/or feedback from the display panel 50. For example, the slew rate control unit 82 may receive a settling signal 86 that indicates the noise or condition of the pixels 52 within the panel 50. The settling signal 86 may include voltage information from common electrodes 65 in the panel 50 which may indicate that settling has not occurred in one or more pixels 52 or columns/rows of pixels 52. In particular, the common electrode 65 for one or more pixels 52 may have disturbance due to the capacitance within circuitry of the pixels 52. The settling signal 86 may also represent capacitance voltages on the gate lines 54 that could cause flickering or other unwanted display event. Additionally, the settling signal 86 may include a disturbance voltage on the data line, gate line, or other circuit component as shown and discussed with regard to FIG. 7.

The slew rate control unit 82 may also receive signals indicative of system noise 88 that may influence the operation of the panel 50. For example, wireless signals (e.g., external noise: cellular signals, near-field communication signals, wireless charging, wireless local internet signals, Bluetooth, power line interference, etc.), touch signals, clock coupling noise, general operation of the processor(s) 18, charging of the power source 26, etc. may impact the interaction of the circuitry of the display 12 and/or the panel 50. The slew rate control unit 82 may receive indications for levels of noise that are present in the device 10 from sensors, or the slew rate control unit 82 may infer an amount of noise based on signal levels.

Figure 7:
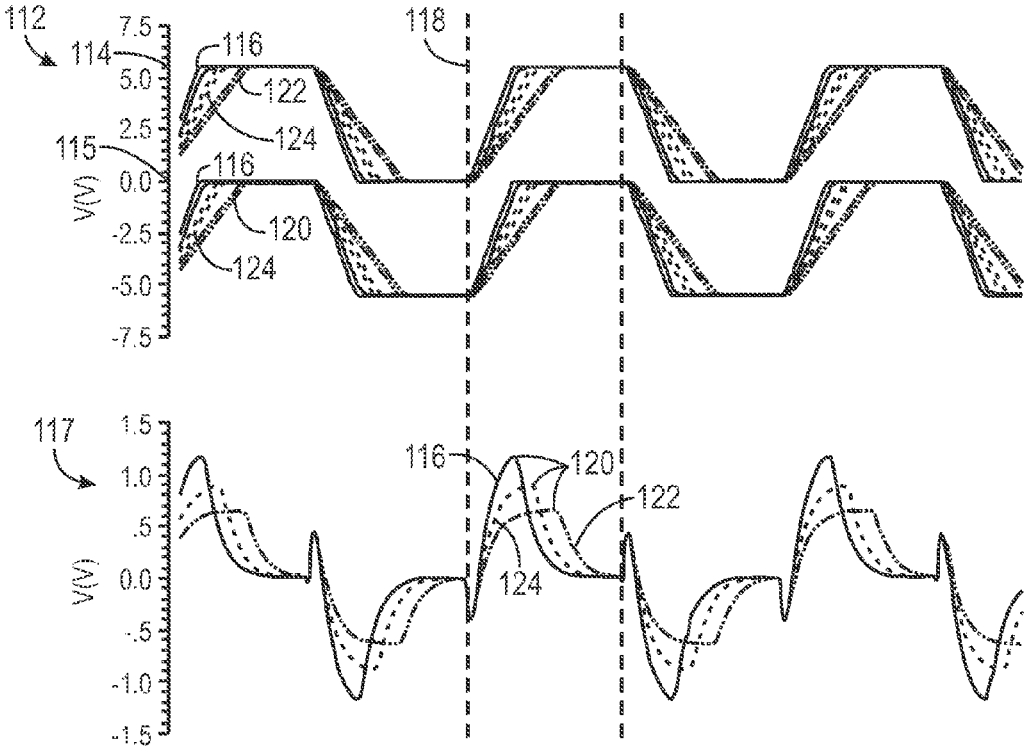
FIG. 7 is a flow chart of the method practiced by the slew rate control unit to control the slew rate within the LCD panel.

Once the source drive IC 68 receives 104 the noise, a noise level and recovery time is determined 106 based on the image data and the noise. The slew rate is then selected 108 to balance the level of noise and the recovery time of the pixels 52 in the display 50. An example of the relationship between slew rate, noise, and recovery time is illustrated in the graph 110 of FIG. 7. The graph 110 includes three examples of the voltage 112 that one of the source drivers 76 may deliver to the source line 56. Each example alternates between a signal voltage 114 and a minimum voltage 115. The abscissa of the graph 110 is time, though the relative distances for which the rising, falling, and maintaining of the voltage 112 in the illustrated embodiment showed not be limiting for other embodiments. The graph 110 shows the relationship of the signal voltage 112 to a disturbance voltage 117 of the common electrode 65. A slew rate of a first data signal 116 has a "high" slew rate such that the first data signal 116 reaches the signal voltage 114 in a short amount of time. A high slew rate corresponds to high peak disturbance 118 of the common electrode 65. In some instances, high disturbance of the common electrode 65 may be less desirable, as disturbances in the common electrode 65 may cause inaccurate color in the display 12. A high slew rate, first slew rate 116, however, also includes disturbance of the common electrode 65 that does not last very long. That is, the total time from a signal start 118 through a peak disturbance 120 to significant drop off in disturbance 117 is short. The length of time in which the common electrode 65 is undisturbed is known as the recovery time, and under some circumstances the recovery time may be used by the device 10 to handle other non-display related operations (e.g., touch sensing). As a contrasting example, if a second slew rate for a second data signal 122 is low, a corresponding peak disturbance 120 is also low, but the common electrode 65 experiences disturbance for a longer duration (i.e., less recovery time). A third slew rate for a third data signal 124 in FIG. 7 shows that a slew rate between the first slew rate of the first data signal 116 and the second slew rate of the second data signal 120 also experiences a peak disturbance 120 and a recovery time that is between the peak disturbance 120 and the recovery time of the first data signal 116 and the second data signal 122. While FIG. 7 illustrates three difference slew rates, the source driver IC 68 may include capabilities for any suitable number of slew rates (e.g., 4, 5, 6, 7, 8, or more different slew rates) at which the source drivers 76 may deliver the signal to the source lines 56. For example, the source driver IC 68 may have three-bit slew rate adjustment capability to select between 8 different slew rates (i.e., LLL to HHH). The corresponding peak disturbances 120 of the common electrode 65 may be stored as a lookup table within the slew rate control unit 82 for any given signal voltage 114 and received noise level.

Returning to the method 100 introduced above, from the discussion of FIG. 7, it may be more clear what evaluation the slew rate control unit 82 considers when selecting 108 the slew rate to send to the source driver 76. For example, the slew rate control unit 82 determines 106, based on the signal voltage 114 and the noise it receives, that a slew rate will correspond to a certain disturbance and/or a certain recovery time. When selecting the slew rate, the slew rate control unit 82 may include a cutoff for recovery time. Any slew rate with a recovery time that is longer than the cutoff recovery time will not be considered a valid option. Of the remaining possible slew rates, the slew rate control unit 82 may select the slew rate that corresponds to the least amount of disturbance 120. As mentioned above, the slew rate control unit 82 may filter the selected slew rate such that the slew rate does not jump significantly, which can cause flickering. For example, if a source driver 76 is currently set at a slew rate of 1 and the slew rate control unit 82 determines that a slew rate of 7 or 8 is desirable, then the slew rate may be filtered first to slew rate 3 or 4 for a second frame, and then 7 or 8 for the subsequent frame afterward. In addition to a cutoff for recovery time, a cutoff for maximum disturbance level 117 may be selected with options to maximize recovery time. The slew rate may be selected either digitally or through analog circuits. For example, the slew rate control unit 82 may includes a look-up table that associates certain noise levels to certain slew rates, while also having some dependence on current slew rate. In certain other embodiments, analog circuits in the source driver IC 68 may amplify noise to set the bias of the line buffer 85, so that the slew rate control unit 82 may adjust the slew rate.

As should be understood, the various techniques described above and relating to slew rate control of a signal are provided herein by way of example. Accordingly, it should be understood that the present disclosure should not be construed as being limited to only the examples provided above. Further, it should be appreciated that the slew rate control disclosed herein techniques may be implemented in any suitable manner, including hardware (suitably configured circuitry), software (e.g., via a computer program including executable code stored on one or more tangible computer readable medium), or via using a combination of both hardware and software elements.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic device comprising:

a display having a plurality of pixels arranged in a grid comprising rows and columns;

a plurality of source drivers each configured to drive one or more columns or rows of pixels with a data signal;

a slew rate control unit configured to incrementally adjust a slew rate of the data signal delivered by the source drivers in the plurality of source drivers during operation of the electronic device to reduce flickering of the display.

2. The electronic device of claim 1, comprising sensors configured to detect noise within the electronic device and deliver a signal indicative of the noise to the slew rate control unit.

3. The electronic device of claim 1, wherein each source driver in the plurality of source drivers may independently adjust the slew rate of the data signal.

4. The electronic device of claim 1, comprising a line buffer configured to compare a first frame of the data signal to a second frame of the data signal and output a signal indicative of a likelihood of noise caused by a data signal within the liquid crystal display.

5. A method for adjusting a slew rate in a liquid crystal display, comprising:

receiving, at a slew rate control unit, a first signal voltage of image data for a first source driver, wherein the first source driver is configured to drive a first column of pixels of the liquid crystal display or a first row of pixels in the liquid crystal display;

receiving, at the slew rate control unit, a noise signal from the liquid crystal display;

determining disturbance levels and recovery times corresponding to each of a first plurality of slew rates of the first signal voltage for the first source driver, wherein:

the disturbance levels comprise voltage levels of voltage disturbances of one or more common electrodes of the liquid crystal display;

the recovery times comprise lengths of time that the one or more common electrodes are undisturbed by the voltage disturbances; and the disturbance levels and the recovery times are based on the first signal voltage and the noise signal;

determining a first set of slew rates from the first plurality of slew rates that correspond to the recovery times that are less than a first cutoff recovery time; and selecting the slew rate from the first set of slew rates that corresponds to the least disturbance level to send to the first source driver.

6. The method of claim 5, comprising receiving, at the slew rate control unit, a second signal voltage of image data for a second source driver, wherein the second source driver is configured to drive a second column of pixels of the liquid crystal display or a second row of pixels in the liquid crystal display;

determining disturbance levels and recovery times corresponding to each of a second plurality of slew rates of the second signal voltage for the second source driver, wherein the disturbance levels and recovery times are based on the second signal voltage and the noise signal;

determining a second set of slew rates from the second plurality of slew rates that correspond to the recovery times that are less than a second cutoff recovery time;

selecting a second slew rate from the second set of slew rates that corresponds to the least disturbance level to send to the second source driver.

7. The method of claim 5, comprising receiving a second frame of image data for the first source driver and determining a second slew rate for the first source driver that is different from the slew rate.

8. The method of claim 7, wherein the second frame of image data comprises image data for a second pixel in the first column of pixels.

9. The method of claim 5, wherein determining the slew rate comprises selecting one of 8 different possible slew rates.

10. The method of claim 5, wherein selecting the slew rate comprises setting the first cutoff for at least one recovery time of the recovery times.

11. The method of claim 5, wherein selecting the slew rate comprises selecting, from a remainder of possible slew rates, the slew rate from the plurality of slew rates that minimizes disturbance level.

12. The method of claim 5, wherein the noise signal comprises touch sensor noise, wireless signal noise, noise from a common voltage layer, or any combination thereof.

13. A source driver integrated circuit (IC), comprising:

one or more tangible, machine-readable media comprising processor-executable instructions to:

receive, at a slew rate control unit, a second signal voltage of image data for a second source driver, wherein the second source driver is configured to drive a second column of pixels of the liquid crystal display or a second row of pixels in the liquid crystal display;

determine disturbance levels and recovery times corresponding to each of a plurality of slew rates of the second signal voltage for the second source driver, wherein:

the disturbance levels comprise voltage levels of voltage disturbances of one or more common electrodes of the liquid crystal display;

the recovery times comprise lengths of time that the one or more common electrodes are undisturbed by the voltage disturbances; and the disturbance levels and the recovery times are based on the second signal voltage and a noise signal;

determine a set of slew rates of the plurality of slew rates that correspond to the disturbance levels that are less than a cutoff disturbance level; and select a slew rate from the set of slew rates that corresponds to the greatest recovery time to send to the second source driver.

14. An electronic device comprising:

one or more input structures;

a storage structure encoding one or more executable routines;

a processor capable of interfacing with the input structures and the storage structure; and a display device configured to display an output of the processor, wherein the display device comprises:

a liquid crystal display (LCD) panel comprising a plurality of pixels arranged in rows and columns, wherein each of the plurality of pixels comprises a thin-film-transistor (TFT), a pixel electrode, and a common electrode, wherein each column of pixels corresponds to a source line of the LCD panel, and wherein each row of pixels corresponds to a gate line of the LCD panel;

a gate driver circuit configured to provide a gate activation signal to gate lines of the LCD panel;

a source driver integrated circuit (IC) configured to send a data signal to source lines of the LCD panel, comprising:

a slew rate control unit configured to receive image data from the processor and output a first slew rate signal by:

determining a set of slew rate signals of a plurality of slew rate signals that each comprise a disturbance level that is less than a cutoff disturbance level, wherein each disturbance level comprises a voltage level of voltage disturbances of at least one common electrode of the LCD panel; and selecting the first slew rate signal from the set of slew rate signals that comprises the greatest amount of recovery time, wherein the recovery time comprise a length of time that the at least one common electrode is undisturbed by the voltage disturbances of the at least one common electrode;

a first source driver configured to drive a first data line at a data signal, wherein the data line alternates between the data signal voltage and a minimum voltage, and the rate at which the first source driver alternates between the data signal voltage and the minimum voltage is controlled by a first slew rate signal from the slew rate control unit.

15. The electronic device of claim 14, wherein the source driver IC comprises a second source driver configured to drive a second data line at the data signal, wherein the data line alternates between the data signal voltage and a second minimum voltage, and the rate at which the second source driver alternates between the data signal voltage and the second minimum voltage is controlled by a second slew rate signal from the slew rate control unit, and the second slew rate signal is different than the first slew rate signal.

16. The electronic device of claim 14, comprising sensors configured to detect system noise within the electronic device, wherein the first slew rate signal is based on an amount of detected system noise.

17. The electronic device of claim 16, wherein system noise includes noise from the one or more input structures.

18. The electronic device of claim 14, wherein the first slew rate signal comprises a first value at a first time, and a second value at a second time.

19. The electronic device of claim 14, wherein the slew rate control unit is configured to receive a settling signal from the gate lines, the thin-film-transistor (TFT), the pixel electrode, the common electrode, or any combination thereof, indicative of stray capacitive voltages, wherein the first slew rate signal depends on the settling signal.

20. The electronic device of claim 14, wherein the first slew rate signal is selected from at least 8 possible slew rate signals.

* * * * *